US006138464A

United States Patent [19]

Derosier et al.

[11] Patent Number: 6,138,464

[45] Date of Patent: Oct. 31, 2000

[54] DEFROST CONTROL FOR SPACE COOLING SYSTEM

[75] Inventors: Gregory S. Derosier, Conyers; James A. Kitchen, Jr., Lawrenceville; Ira Z. Richter, Lilburn, all of Ga.

[73] Assignee: Heatcraft Inc., Grenada, Miss.

[21] Appl. No.: 09/427,520

[22] Filed: Oct. 25, 1999

Related U.S. Application Data

[62] Division of application No. 08/835,255, Apr. 8, 1997, Pat. No. 5,970,726.

[51] Int. Cl.[7] ..... F25D 21/06

[52] U.S. Cl. ..... 62/155; 62/234

[58] Field of Search ..... 62/155, 156, 140, 62/234, 152, 153, 154, 158

[56] References Cited

U.S. PATENT DOCUMENTS

| | | | |
|---|---|---|---|
| 3,894,404 | 7/1975 | Stanton | 62/155 |
| 4,067,203 | 1/1978 | Behr | 62/208 |
| 4,151,722 | 5/1979 | Willitts et al. | 62/234 X |
| 4,151,723 | 5/1979 | Gardner | 62/156 X |
| 4,338,790 | 7/1982 | Saunders et al. | 62/80 |
| 4,406,133 | 9/1983 | Saunders et al. | 62/80 |
| 4,428,206 | 1/1984 | Massa | 62/140 |
| 4,523,435 | 6/1985 | Lord | 62/212 |
| 4,573,326 | 3/1986 | Sulfstede et al. | 62/156 |
| 4,617,804 | 10/1986 | Fukushima et al. | 62/212 |
| 4,620,424 | 11/1986 | Tanaka et al. | 62/222 |
| 4,674,292 | 6/1987 | Ohya et al. | 62/223 |
| 4,787,213 | 11/1988 | Gras et al. | 62/212 |
| 4,882,908 | 11/1989 | White | 62/155 |
| 4,884,414 | 12/1989 | Bos | 62/156 |
| 5,315,835 | 5/1994 | Park | 62/80 |
| 5,415,005 | 5/1995 | Sterber et al. | 62/154 |
| 5,528,908 | 6/1996 | Bahel et al. | 62/81 |
| 5,551,248 | 9/1996 | Derosier | 62/155 |

FOREIGN PATENT DOCUMENTS 0 501 387 B1 7/1996 European Pat. Off. .

*Primary Examiner*—Harry B. Tanner
*Attorney, Agent, or Firm*—W. Kirk McCord

[57] ABSTRACT

An improved defrost controller is provided for a space cooling system of the type having an evaporator in heat exchange relationship with a space to be cooled, a condenser external to the space, a compressor for circulating heat transfer fluid between the evaporator and condenser, an expansion valve located between an outlet from the condenser and an inlet to the evaporator, and a defroster operatively associated with the evaporator. The expansion valve is positionable in a plurality of positions between a fully open position and a fully closed position to maintain a desired level of superheat across the evaporator. The defrost controller monitors the expansion valve position and activates the defroster in response to the expansion valve being in a more closed position than a predetermined defrost target position. The defrost controller is further operable to prevent defrosting from occurring at times other than predetermined allowed defrost times, even if the position of the expansion valve indicates a demand for defrost. The defrost target position is adjusted in response to changes in selected system operating parameters. Further, at each allowed defrost time, the controller determines whether defrosting can be deferred until a next allowed defrost time, based on the then current rate of degradation in evaporator performance. If the then current rate of degradation indicates that defrosting cannot be deferred to the next allowed defrost time, the controller activates the defroster, even if a demand for defrost is not indicated.

10 Claims, 8 Drawing Sheets

DEFROST CONTROL FOR SPACE COOLING SYSTEM

CROSS-REFERENCE TO RELATED APPLICATION

This application is a division of prior application Ser. No. 08/835,255, filed Apr. 8, 1997, U.S. Pat. No. 5,970,726.

TECHNICAL FIELD

This invention relates generally to space cooling systems and in particular to apparatus for controlling the defrost operation in a space cooling system.

BACKGROUND ART

Space cooling systems, including both refrigeration and comfort cooling systems, typically include one or more evaporators in heat exchange relationship with a space to be cooled, a condenser external to the space, a compressor for circulating a heat transfer medium, such as a vapor compression refrigerant, between the evaporator and the condenser, and an expansion valve located between the condenser outlet and the inlet to each evaporator. Each expansion valve may be positionable at various intermediate positions between a fully open position and a fully closed position to regulate the flow rate of the heat transfer medium through the evaporator. An indoor fan is usually provided to direct a flow of cooling air across the evaporator and an outdoor fan is usually provided for cooling the condenser.

Modern-day space cooling systems may also include a microcomputer programmed to control operation of the system based on inputs from various temperature and pressure sensors. Each expansion valve may be controlled in response to the measured temperature differential across the corresponding evaporator. This temperature differential is commonly referred to as the evaporator superheat. Various techniques for controlling the expansion valve in response to evaporator superheat are set forth in U.S. Pat. Nos. 4,067,203; 4,523,435; 4,617,804; 4,620,424; 4,674,292; 4,787,213; and 5,551,248.

Space cooling systems also typically include some type of mechanism which is operable to prevent frost build-up on the evaporator(s) and a device for controlling operation of the defrost mechanism. Defrosting may be accomplished in a number of different ways, including using an electrically resistive heating element to heat each evaporator, introducing hot gas into the evaporator, or operating the indoor fan to melt the frost accumulated on the evaporator. The defrost operation may be initiated based on a pre-programmed time between successive defrost operations, or, alternatively, in response to selected indicators, such as evaporator temperature, ambient air temperature, optical detection of frost build-up, compressor run time, or evaporator cooling fan performance. The defrost operation may be terminated in response to a predetermined elapsed time since the onset thereof, or, alternatively, in response to an indication that the evaporator temperature has reached a predetermined target temperature. Prior art examples of defrost controls therefor are shown in U.S. Pat. Nos. 4,338,790; 4,406,133; 4,573,326; 4,882,908; 5,315,835; and 5,415,005; and in European Patent Application EP 0 501 387/B1.

One of the problems associated with prior art defrost controls, particularly those in which the defrost operation is initiated at regular time intervals, is that the defrost operation may be initiated at times when there is really not a need to defrost the evaporator(s). Further, even if there is a need for defrosting, there may be certain times of day (ie., periods of peak cooling requirements) during which it is not desirable to interrupt normal system operation in order to defrost the evaporator(s).

There is therefore a need for improved apparatus for controlling the defrost operation in a space cooling system.

SUMMARY OF THE INVENTION

In accordance with the present invention, apparatus is provided for controlling the defrost operation in a space cooling system of the type having a first heat exchanger in heat exchange relationship with the space to be cooled, a second heat exchanger external to the space, a circulating device for circulating heat transfer fluid between the first and second heat exchangers, a regulating device located between the first and second heat exchangers for regulating heat transfer fluid flow rate through the first heat exchanger, and a defroster operatively associated with the first heat exchanger.

In accordance with a feature of the invention, the control apparatus activates the defroster in response to both of the following conditions having been satisfied: (i) a demand for defrost is indicated by a change in a selected one or more system operating parameters indicating degradation in performance of the first heat exchanger due to frost buildup thereon; and (ii) the demand for defrost occurs at a predetermined allowed defrost time. In accordance with one embodiment of the invention, degradation in performance of the first heat exchanger is indicated by reduced heat transfer fluid flow rate through the first heat exchanger.

In accordance with another feature of the invention, the control apparatus includes means responsive to the absence of a demand for defrost for determining at each allowed defrost time whether defrosting can be deferred until the next allowed defrost time based on the then current rate of degradation in performance of the first heat exchanger. In accordance with one embodiment of the invention, the determining means includes computing means for computing first and second ratios, the first ratio having a numerator which represents degradation in performance of the first heat exchanger compared to a predetermined reference performance and a denominator which represents a predetermined allowed degradation in performance of the first heat exchanger compared to the reference performance, and the second ratio having a numerator which represents time elapsed since a last defrost operation and a denominator which represents a time interval from the last defrost operation to a next allowed defrost time. The determining means further includes comparing means for comparing the first and second ratios. The control apparatus is further operable to activate the defroster at an allowed defrost time in response to the first ratio being greater than or equal to the second ratio. Therefore, in accordance with this feature of the invention, the control apparatus determines, in the absence of a demand for defrost, whether defrosting can be deferred until the next allowed defrost time, based on the then current rate of degradation in performance of the first heat exchanger.

In accordance with yet another feature of the invention, the control apparatus adjusts for changes in the selected one or more system operating parameters which are not attributable to frost build-up on the first heat exchanger.

In accordance with a preferred embodiment of the invention, the heat transfer fluid flow regulating device is a valve and the degradation in performance of the first heat exchanger is determined by monitoring the position of the valve. The control apparatus is operable to activate the defroster in response to an indication that the valve is in a more closed position than a predetermined defrost target position and to deactivate the defroster in response to a predetermined condition having been satisfied (e.g. maximum defrost time has elapsed or the temperature of the first heat exchanger has reached a predetermined target temperature). As the performance of the first heat exchanger continues to degrade due to frost build-up thereon, the valve is moved to a more closed position to maintain a desired rate of heat transfer fluid flow through the first heat exchanger. When the valve closes below the defrost target position, it indicates frost build-up to the extent that there is a need to defrost the first heat exchanger.

The defrost control apparatus of the present invention combines the advantages of a so-called "demand defrost" control system with the advantages of a defrost control system which inhibits defrosting during certain time periods. By monitoring changes in the heat transfer fluid flow rate through the first heat exchanger, preferably by monitoring the position of the flow rate regulating valve, the control apparatus initiates the defrost operation when there is a demand therefor, but only if the demand occurs at a predetermined allowed defrost time. Further, the control apparatus may initiate defrosting at an allowed defrost time, even in the absence of a demand for defrost, if it determines that the rate of degradation in performance of the first heat exchanger is such that it is advisable to defrost the evaporator without waiting until the next allowed defrost time.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
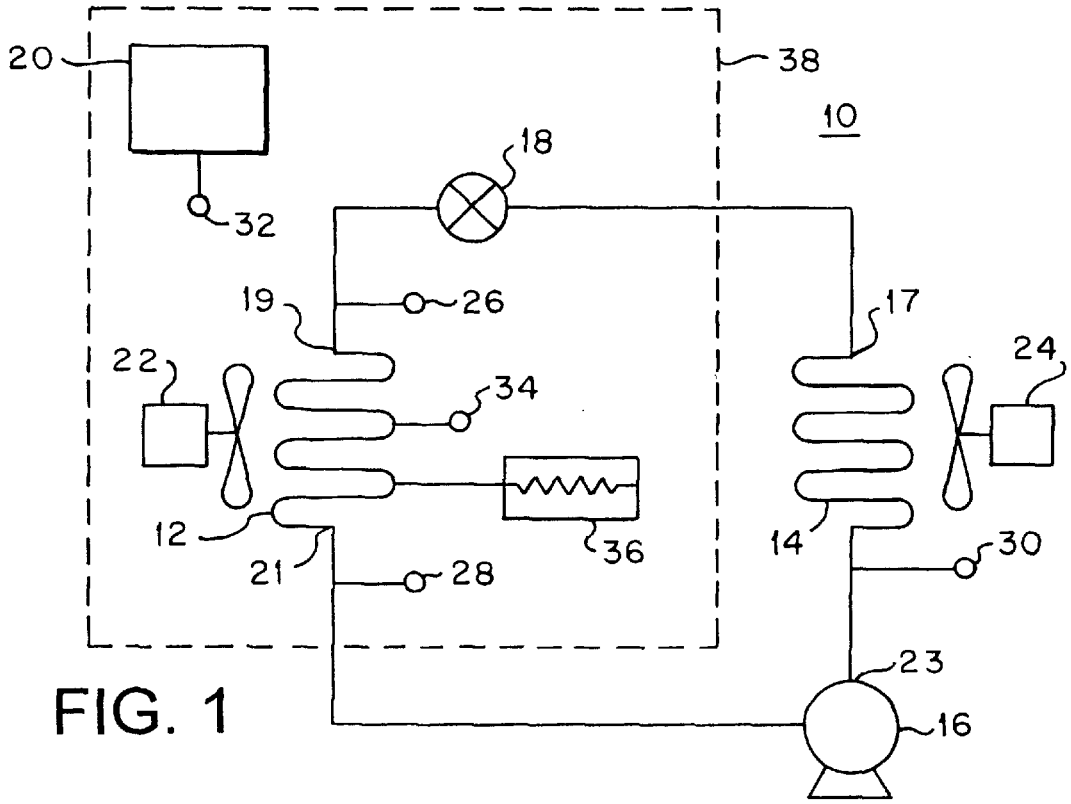
FIG. 1 is a schematic of a space cooling system, including a controller for controlling the system defrost operation, according to the present invention.

Referring to FIG. 1, a space cooling system 10 is depicted. System 10 includes a first heat exchanger (e.g., an evaporator 12) in heat exchange relationship with an indoor space to be cooled (e.g., a refrigerated compartment), a second heat exchanger (eg., a condenser 14) external to the space, a circulating device for circulating heat transfer fluid (e.g., a compressor 16 for circulating a vapor compression refrigerant) between evaporator 12 and condenser 14, and a regulating device (e.g., an expansion valve 18) located between an outlet side 17 of condenser 14 and an inlet side 19 of evaporator 12 for regulating the flow rate of the heat transfer fluid through evaporator 12. A microcomputer-based controller 20 is provided to control operation of system 10. An indoor fan 22 is provided for directing ambient air in the space to be cooled across evaporator 12. An outdoor fan 24 is provided for directing outdoor air, which acts as a cooling medium, across condenser 14. Evaporator 12 and condenser 14 are both heat transfer coils, preferably with multiple passes, as illustrated in FIG. 1.

Expansion valve 18 is positionable in a fully open position to allow refrigerant to enter evaporator 12 substantially unimpeded, in a fully closed position to substantially inhibit refrigerant from entering evaporator 12, and in a plurality of intermediate positions between the fully open position and the fully closed position to regulate the flow rate of refrigerant through evaporator 12. Expansion valve 18 may be of the type operated by an electrically operable solenoid (not shown) or an electrically operable step motor (not shown). In either case, expansion valve 18 is adjustable in selected increments to regulate the flow rate of refrigerant through evaporator 12.

First and second temperature sensors 26, 28 are respectively positioned on inlet side 19 and on an outlet side 21 of evaporator 12 for sensing the temperature differential across evaporator 12. The temperature differential across evaporator 12 corresponds to a level of superheat of the refrigerant as it passes through evaporator 12. A third temperature sensor 30 is located on a discharge side 23 of compressor 16 for measuring compressor discharge temperature (or outdoor ambient air temperature when compressor 16 is not operating) and a fourth temperature sensor 32 measures the ambient air temperature of the space to be cooled. Temperature sensors 26, 28, 30, 32 are preferably thermistors.

A fifth temperature sensor 34, also preferably a thermistor, is provided for sensing the temperature of evaporator 12 and an electrically resistive defrost heater 36 is provided to heat evaporator 12 to melt frost build-up thereon when system 10 is operated in a defrost mode. Alternatively, hot gas may be introduced into evaporator 12 to melt the frost thereon during the defrost mode.

Evaporator 12, expansion valve 18, controller 20, indoor fan 22, temperature sensors 26, 28, 32, 34, and defrost heater 36 are typically housed in an indoor unit 38, which is defined by the dashed lines in FIG. 1. Condenser 14, compressor 16, outdoor fan 24 and temperature sensor 30 are typically housed in an outdoor unit.

Controller 20 preferably includes a microcomputer of the ST62T25 type, manufactured and sold by SGS-Thomson Microelectronics, of Phoenix, Ariz., and a control board having a plurality of input and output connections. Controller 20 controls various functions and components of system 10 in response to inputs from various sensors, including temperature sensors 26, 28, 30, 32, 34. One such function controlled by controller 20 is the system defrost mode, whereby from time to time heater 36 is activated to apply heat to evaporator 12, whereby frost on the external surfaces of evaporator 12 is melted. The operation of controller 20 to control the defrost mode will be described in greater detail hereinbelow with reference to FIGS. 2–10.

Figure 2:
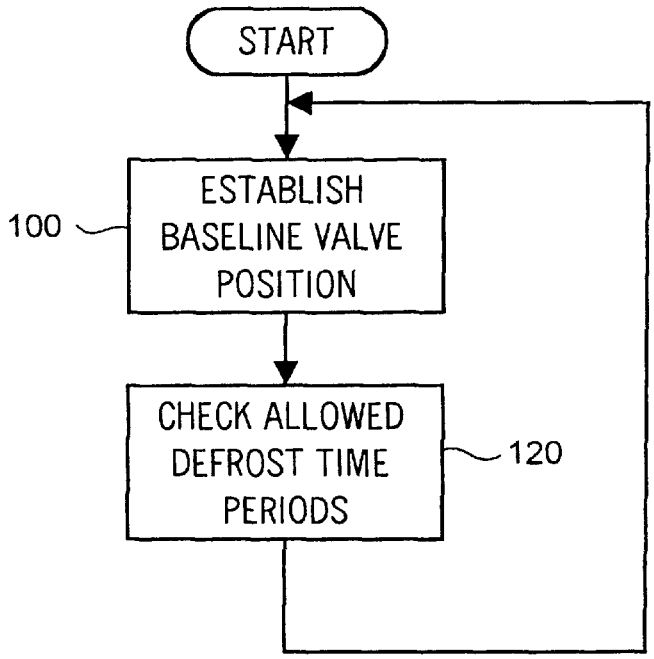
FIGS. 2–10 are flow diagrams, depicting the sequence of operation of the defrost controller, according to the present invention.
Figure 3:
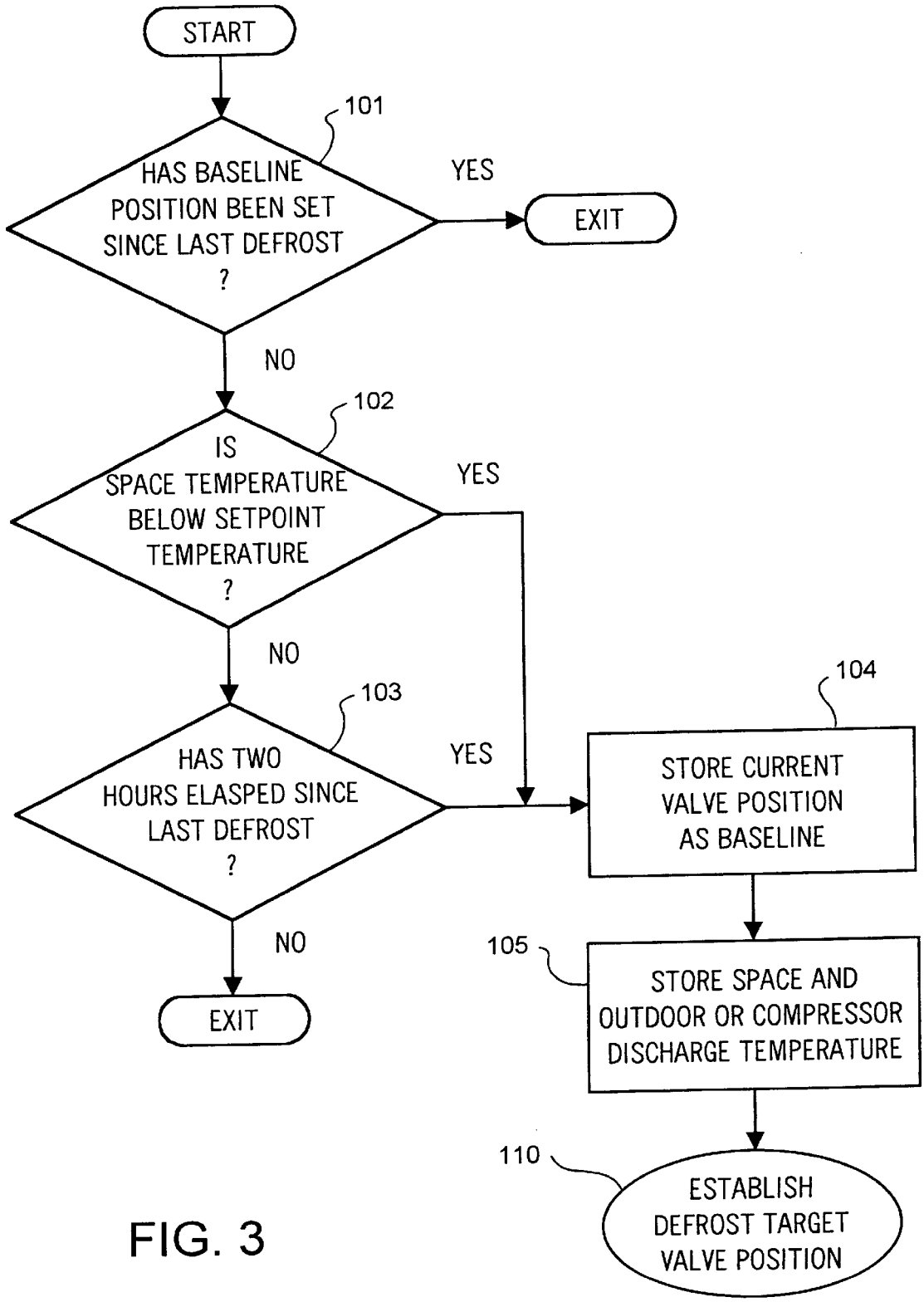

Referring to FIGS. 1, 2 and 3, controller 20 (FIG. 1) performs an Establish Baseline Valve Position Routine 100 (FIG. 2) upon system power up, which will now be described in greater detail with reference to FIG. 3. Pursuant to step 101, controller 20 determines whether a baseline position of expansion valve 18 has been set since the last defrost operation. If it has, Routine 100 is exited. If it has not, controller 20 determines, pursuant to step 102, whether the space temperature, as measured by sensor 32 (FIG. 1), is below a predetermined setpoint temperature. If it is not, controller 20 then determines, pursuant to step 103, whether at least two hours have elapsed since the last defrost operation. If at least two hours have not elapsed, controller 20 exits Routine 100. If either the space temperature is below the setpoint temperature (step 102) or at least two hours have elapsed since the last defrost operation (step 103), the current position of expansion valve 18 (FIG. 1) is stored as the baseline position, pursuant to step 104. The baseline valve position is used as a reference position in determining the existence of a demand for defrost condition. In order to establish a valid reference position, the space temperature should either be at or below the setpoint temperature or at least two hours should have elapsed since the end of the last defrost operation, to allow the operation of system 10 (FIG. 1) to reach a relatively steady state. Further, the baseline position is established only once between successive defrost operations (step 101).

Pursuant to step 105, the space temperature, as measured by sensor 32 (FIG. 1), and the temperature measured by sensor 30 (FIG. 1) are stored. The temperature measured by sensor 30 on discharge side 23 of compressor 16 (FIG. 1) corresponds to the temperature of the heat transfer fluid on discharge side 23 when compressor 16 is operating and to the outdoor ambient air temperature when compressor 16 is not operating. It is important that the temperatures measured by sensors 30, 32 at the time that the baseline valve position is established be stored because changes in these temperature parameters may affect the baseline valve position and necessitate an adjustment thereto, as will be described in greater detail with reference to FIG. 9. A defrost target valve position is then established with reference to the baseline valve position, pursuant to an Establish Defrost Target Valve Position Subroutine 110, which will now be described in greater detail with reference to FIG. 4.

Figure 4:
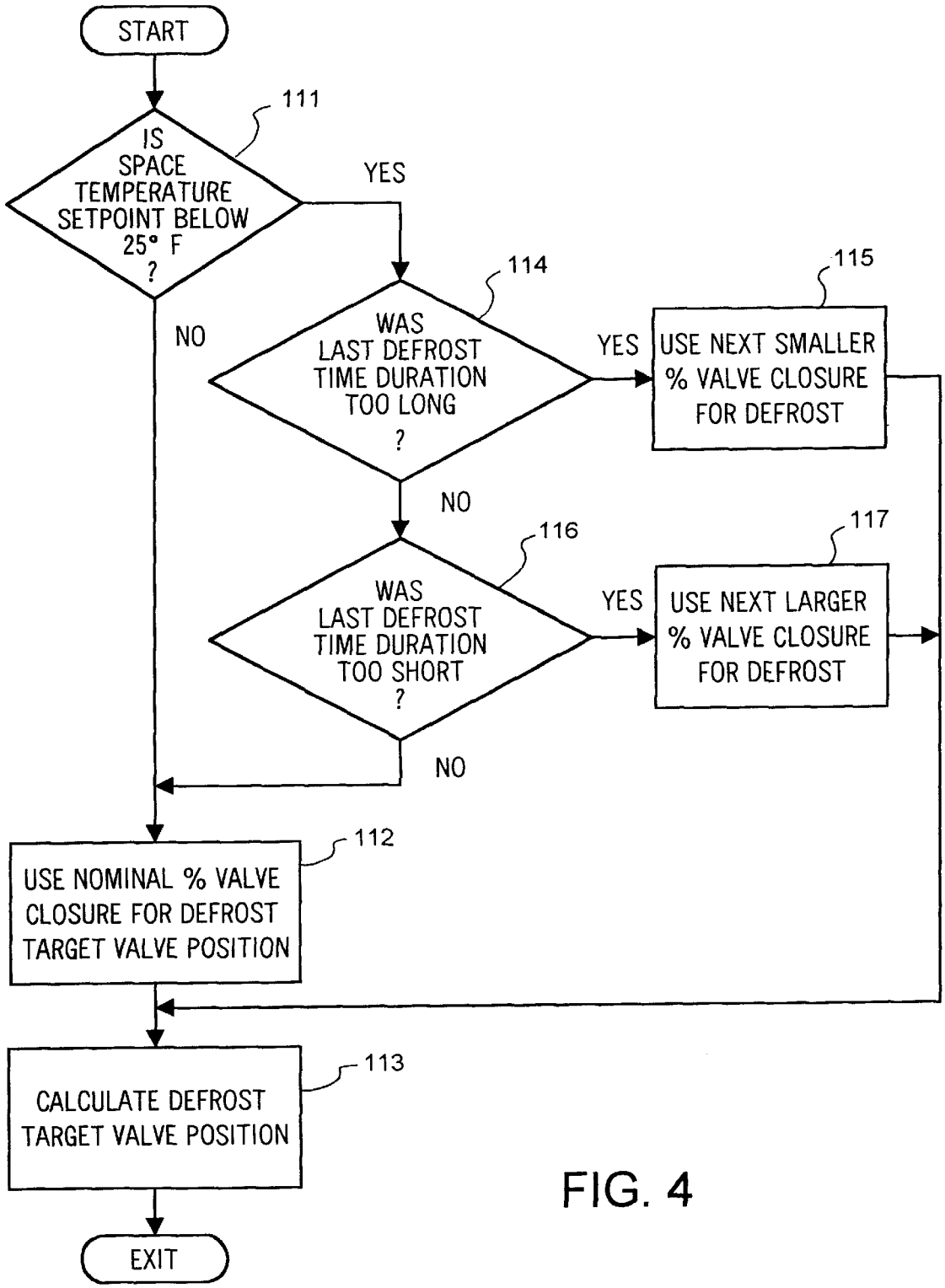

Referring to FIGS. 1 and 4, controller 20 (FIG. 1) performs Subroutine 110 (FIG. 3) to determine a defrost target position of expansion valve 18 (FIG. 1) with reference to the baseline valve position. Pursuant to step 111, controller 20 determines whether the space temperature setpoint (ie., the setpoint of sensor 32) is below a predetermined temperature (eg., 25° F.). If it is not, controller 20 assigns, pursuant to step 112, a predetermined nominal percentage (e.g., 20%) below the baseline valve position, which corresponds to a position of expansion valve 18 that is 20% more closed than the baseline valve position. The position of expansion valve 18 is adjusted incrementally in selected steps, the step sizes being variable. For example, expansion valve 18 may be positionable at 255 discrete binary coded positions, with position 0 corresponding to the fully closed position, position 255 corresponding to the fully open position and the positions between 0 and 255 corresponding to intermediate positions between the fully closed position and the fully open position. For example, if the baseline valve position is set at 100 and the defrost target position is set 20% below the baseline position, the binary coded position corresponding to the defrost target position would be position 80 (i.e., 20% below position 100). The defrost target valve position is calculated accordingly, pursuant to step 113 and Subroutine 110 is exited.

If, however, controller 20 determines that the space temperature setpoint is below 25° F. (step 111), controller 20 determines, pursuant to step 114, whether the duration of the last defrost operation was too long (e.g., more than 35 minutes). A relatively long defrost time indicates that degradation in the performance of evaporator 12 (FIG. 1) at the onset of the last defrost operation was greater than an acceptable level of degradation, thereby resulting in a longer than acceptable defrost time. Controller 20 uses this information to adjust the defrost target position to a more open position, pursuant to step 115. Typically, the defrost target position is adjusted in increments of 2%. For example, if the current defrost target position is 20% below the baseline position, the defrost target position is adjusted so that the new defrost target position is 18% below the baseline position, which corresponds to a position which is 18% more closed than the baseline position. Assuming a baseline position of 100, the new defrost target position would be 82.

If the duration of the last defrost operation was not too long (e.g., not more than 35 minutes), controller 20 then determines, pursuant to step 116, whether the duration of the last defrost operation was too short (e.g., less than 15 minutes). A relatively short defrost time indicates that the degradation in performance of evaporator 12 at the onset of the last defrost cycle was less than an acceptable level of degradation, thereby resulting in a shorter than acceptable defrost time. In that case, controller 20 adjusts the defrost target position to correspond to a more closed position of expansion valve 18, pursuant to step 117. For example, if the current defrost target position is 20% below the baseline position, the defrost target position is adjusted so that the new defrost target position is 22% below the baseline position, which corresponds to a position that is 22% more closed than the baseline position. Assuming a baseline position of 100, the new target position would be 78. The defrost target position will not be adjusted by more than two increments (4%) either above or below the nominal defrost target position. Therefore, if the nominal defrost target position is 20%, the defrost target position is adjustable between 16% (eg., position 84 for a baseline position of 100) and 24% (e.g., position 76 for a baseline position of 100).

Figure 5:
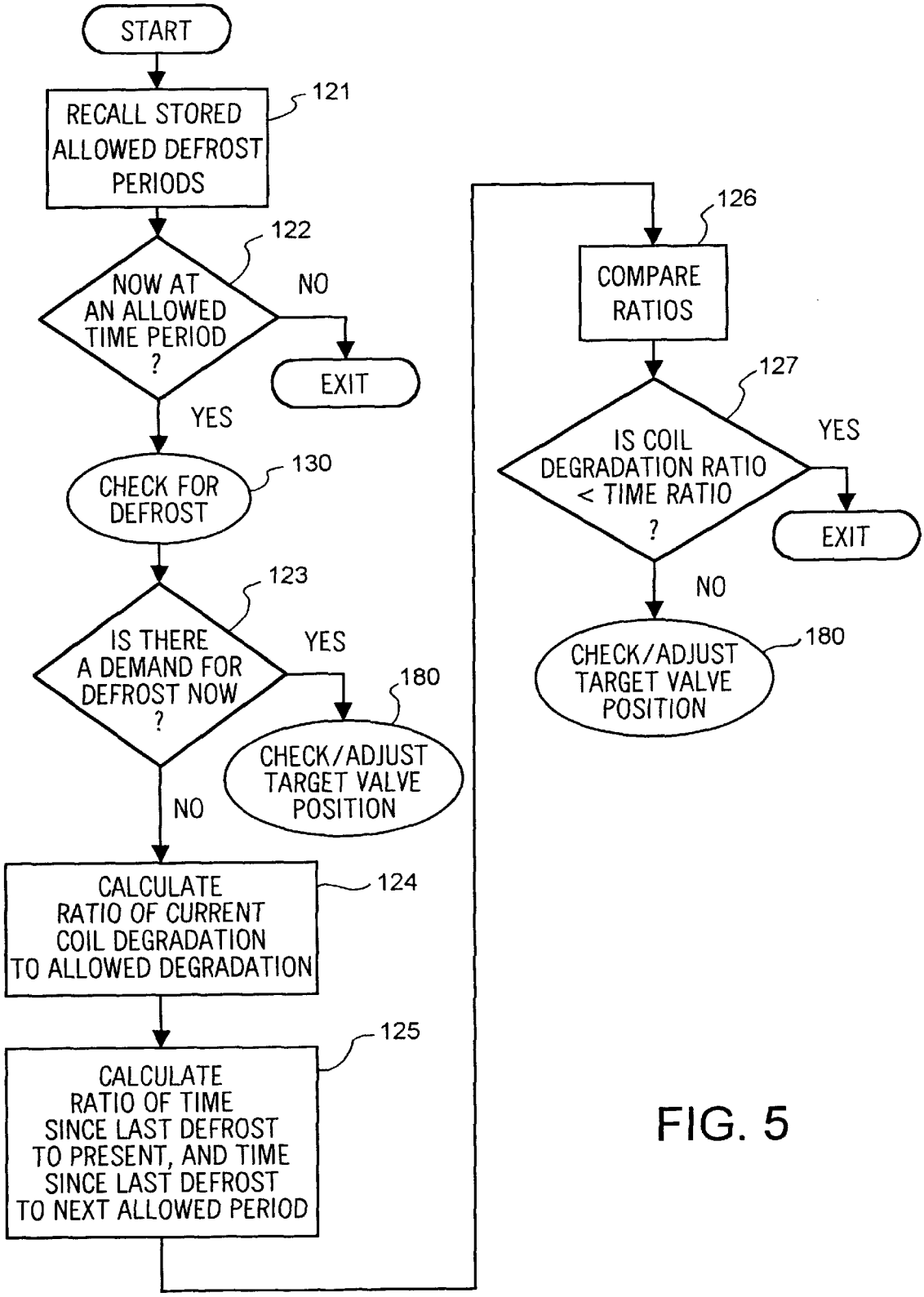
Figure 6:
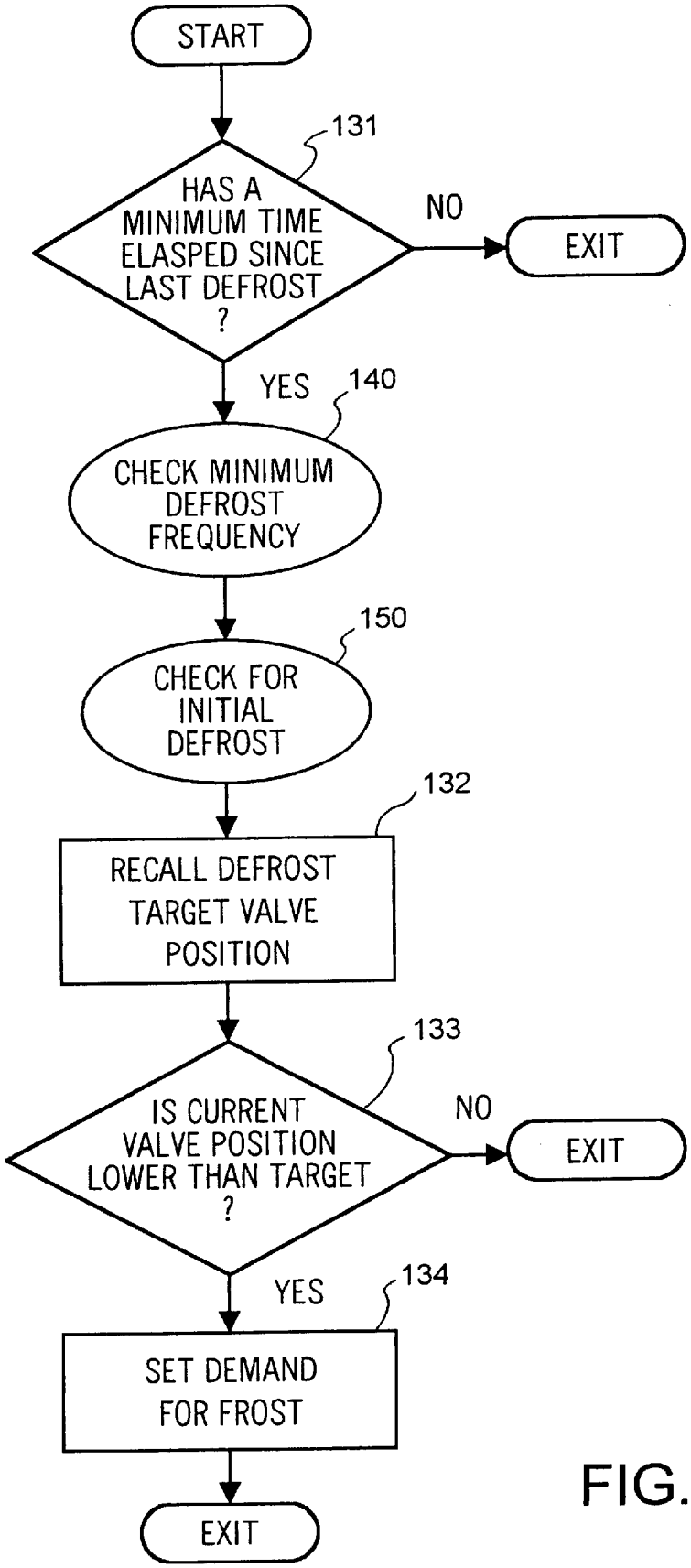
Figure 7:
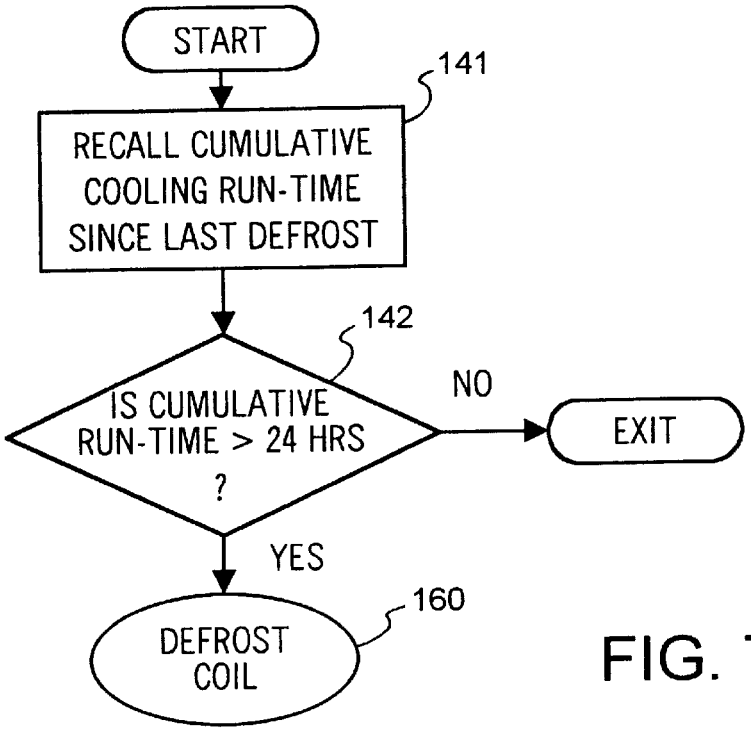

Referring to FIGS. 1, 2, 5 and 6, controller 20 (FIG. 1) performs a Check Allowed Defrost Time Periods Routine 120 (FIG. 2), which will now be described in greater detail with reference to FIG. 5. Pursuant to step 121, controller 20 recalls the stored allowed defrost time periods, for which controller 20 is user-programmable. The allowed defrost time periods are typically programmed as predetermined time intervals (e.g., 20 minutes) during which the defrost operation may be commenced. If controller 20 determines, pursuant to step 122, that the then current time is not an allowed defrost period, Routine 120 is exited. If the then current time does correspond to an allowed defrost time period, controller 20 performs a Check For Defrost Subroutine 130, which will now be described in greater detail with reference to FIG. 6.

Pursuant to step 131 (FIG. 6), controller 20 determines whether a minimum time (e.g., two hours) has elapsed since the last defrost operation. If a minimum time has not elapsed since the last defrost operation, Subroutine 130 is exited. If a minimum time has elapsed since the last defrost operation (step 131), controller 20 performs a Check Minimum Defrost Frequency Subroutine 140, which will now be described in greater detail with reference to FIG. 7.

Pursuant to step 141 (FIG. 7), controller 20 recalls the cumulative cooling run-time since the last defrost operation. Controller 20 then determines, pursuant to step 142, whether the cumulative run-time since the last defrost operation has been greater than 24 hours. If so, heater 36 (FIG. 1) is activated to defrost evaporator 12 (FIG. 1), pursuant to a Defrost Coil Subroutine 160, which will be described in greater detail hereinafter with reference to FIG. 10. If not, Subroutine 140 is exited. Therefore, pursuant to Subroutine 140, controller 20 ensures that defrosting occurs at least once every 24 hours, irrespective of whether there is a demand therefor.

Figure 8:
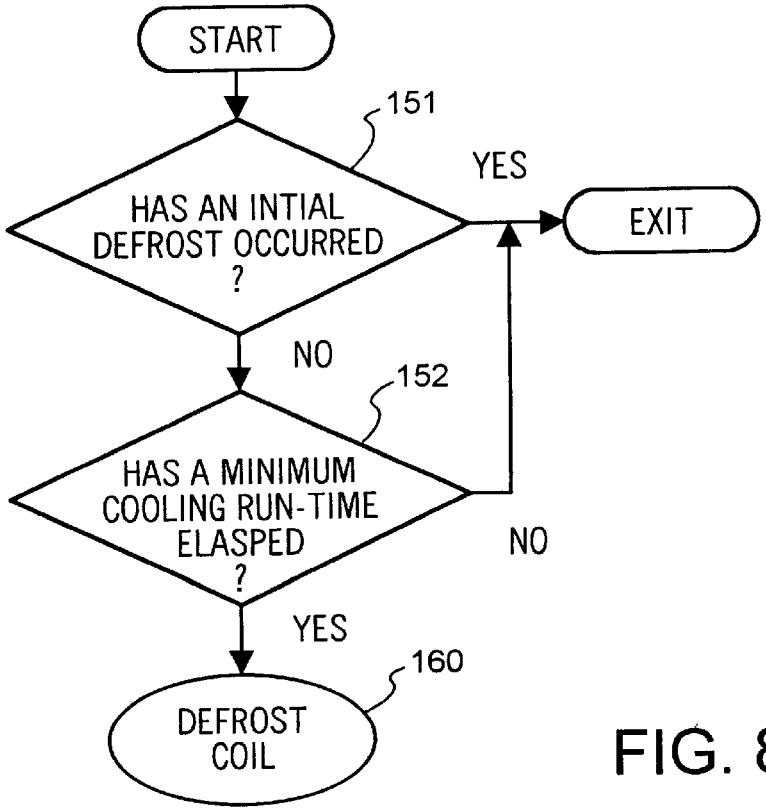

If the cumulative run-time since the last defrost operation has not been greater than 24 hours, controller 20 performs a Check For Initial Defrost Subroutine 150, which will now be described in greater detail with reference to FIG. 8. If an initial defrost operation has already occurred (step 151), controller 20 exits Subroutine 150. If the initial defrost operation has not yet occurred, controller 20 determines, pursuant to step 152, whether a predetermined minimum cooling run time (e.g., four hours) has elapsed since system power up. If it has not, Routine 150 is exited. If the minimum cooling run time has elapsed, controller 20 activates heater 36 (FIG. 1) to accomplish the initial defrost operation, pursuant to Defrost Coil Subroutine 160. Therefore, pursuant to Subroutine 150, controller 20 ensures that the initial defrost operation occurs within a predetermined time (e.g., four hours) after system power up.

Referring again to FIG. 6, if Subroutine 140 and Subroutine 150 are both exited without performing Defrost Coil Subroutine 160, controller 20 then recalls, pursuant to step 132, a defrost target valve position established pursuant to Subroutine 110 (FIG. 4) and determines, pursuant to step 133, whether the then current position of expansion valve 18 (FIG. 1) is lower (i.e., in a more closed position) than the defrost target position. If it is not, Subroutine 130 is exited. If it is, controller 20 indicates a demand for defrost, pursuant to step 134, and Subroutine 130 is exited. One skilled in the art will recognize that in order for a demand for defrost to be indicated, both of the following conditions must have been satisfied: (i) the current position of expansion valve 18 is lower (i.e., in a more closed position) than the defrost target valve position determined pursuant to step 113 in FIG. 4; and (ii) a minimum time (e.g., two hours) has elapsed since the last system defrost operation.

Figure 9:
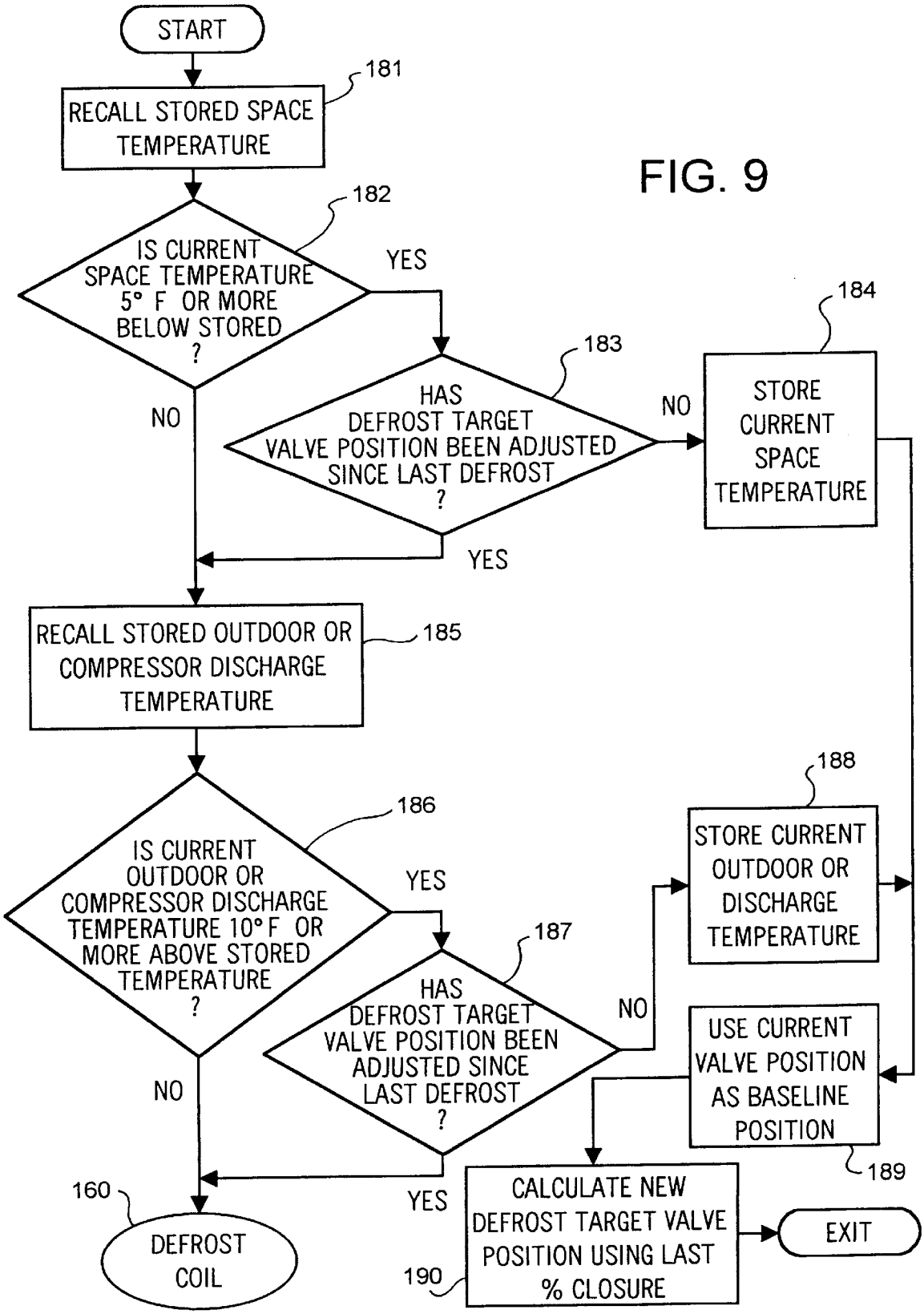

Referring again to FIG. 5, if Subroutine 130 indicates a demand for defrost, controller 20 determines, pursuant to step 123, that there is a need for system defrost and performs a Check/Adjust Defrost Target Valve Position Subroutine 180, which will now be described in greater detail with reference to FIG. 9.

Pursuant to step 181 (FIG. 9), controller 20 recalls the stored space temperature (step 105 in FIG. 3). Controller 20 then determines, pursuant to step 182 whether the current space temperature is 5° F. or more below the recalled stored space temperature. If it is, controller 20 next determines, pursuant to step 183, whether the defrost target valve position has been adjusted since the last defrost operation. If it has not, the current space temperature is stored in lieu of the recalled stored space temperature, pursuant to step 184. If the current space temperature is not 5° F. or more below the recalled stored space temperature or if the defrost target valve position has been adjusted since the last defrost operation, the current space temperature is not stored.

If the current space temperature is not stored in lieu of the recalled stored space temperature, controller 20 then recalls the stored outdoor or compressor discharge temperature (the temperature stored pursuant to step 105 in FIG. 3), pursuant to step 185. Controller 20 then determines, pursuant to step 186 whether the current outdoor or compressor discharge temperature is 10° F. or more above the recalled stored space temperature. If it is, controller 20 next determines, pursuant to step 187, whether the defrost target valve position has been adjusted since the last defrost operation. If it has not, the current outdoor or discharge temperature is stored, pursuant to step 188, in lieu of the recalled stored outdoor or compressor discharge temperature.

If the current outdoor or compressor discharge temperature is not 10° F. or more above the recalled stored outdoor or compressor temperature (step 186) or if the defrost target valve position has been adjusted since the last defrost operation (step 187), the current outdoor or discharge temperature is not stored and Defrost Coil Subroutine 160 is executed. If either the current space temperature or the current outdoor or discharge temperature is stored, pursuant to step 184 or step 188, the current position of expansion valve 18 is used as the baseline position, pursuant to step 189. If the current position of expansion valve 18 is used as the new baseline position, a new defrost target valve position is calculated, pursuant to step 190, using the valve closure percentage determined pursuant to step 112, step 115 or step 117 in FIG. 4. Subroutine 180 is then exited.

Referring again to FIG. 5, if a demand for defrost is not indicated, pursuant to step 123, but the current time corresponds to an allowed defrost time (step 121), controller 20 determines whether the current rate of degradation in performance of evaporator 12 is such that defrosting should be accomplished now or can be deferred until the next allowed defrost time. Pursuant to step 124, controller 20 calculates a first ratio, the numerator of which is the current degradation in performance of evaporator 12 compared to a predetermined reference performance and the denominator of which is a maximum allowed degradation in performance compared to the reference performance. Controller 20 calculates a second ratio, pursuant to step 125, the numerator of which is time elapsed since the last defrost operation and the denominator of which is the time between the last defrost operation and the next allowed defrost time. The first and second ratios are compared, pursuant to step 126. Controller 20 determines, pursuant to step 127, whether the first ratio (coil degradation ratio) is less than the second ratio (time ratio). If it is, then controller 20 determines that defrosting can be deferred until the next allowed time. However, if controller 20 determines that the first ratio is greater than or equal to the second ratio, pursuant to step 127, it indicates that the current rate of degradation in performance of evaporator 12 is such that defrosting cannot be deferred until the next allowed time. As a result, controller 20 initiates Check/Adjust Target Valve Position Subroutine 180, as described hereinabove with reference to FIG. 9.

Figure 10:
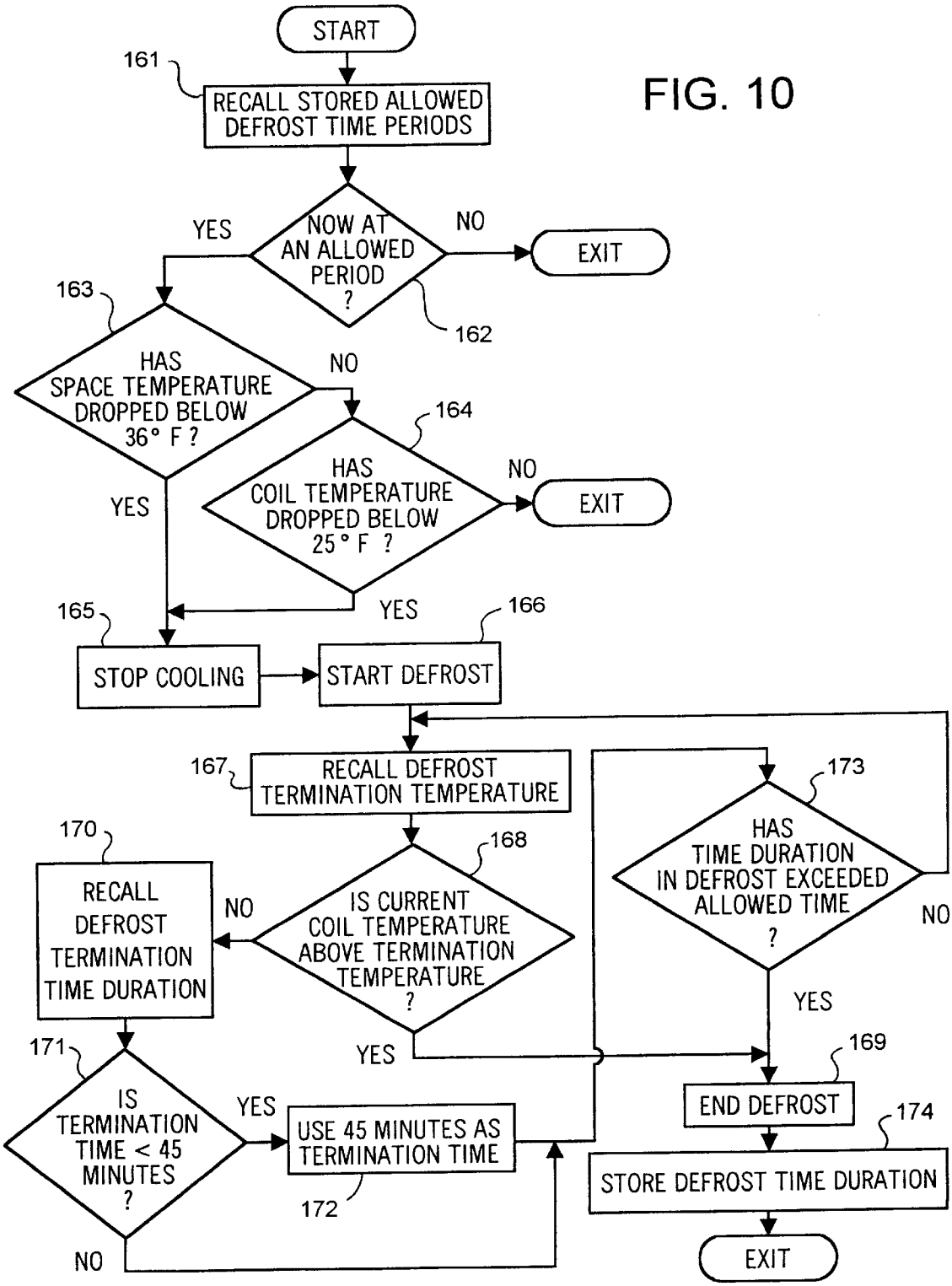

Referring to FIGS. 1 and 10, Defrost Coil Subroutine 160 will now be described in greater detail. Pursuant to step 161, controller 20 recalls the stored allowed defrost time periods. If the then current time corresponds to an allowed defrost time period (step 162), controller 20 determines, pursuant to step 163 whether the space temperature has dropped below 36° F. If it has not, controller 20 determines, pursuant to step 164, whether the coil temperature of evaporator 12 has dropped below 25° F. If it has not, Subroutine 160 is exited. If either the space temperature has dropped below 36° F. (step 163) or the coil temperature of evaporator 12 has dropped below 25° F. (step 164), the normal cooling mode of system 10 is terminated, pursuant to step 165 and the defrost mode of operation is commenced, pursuant to step 166.

Pursuant to step 167, controller 20 recalls a stored defrost termination temperature, which corresponds to the coil temperature of evaporator 12, as measured by sensor 34 (FIG. 1), at which the defrost operation is to be terminated. If the current coil temperature of evaporator 12 is above the stored termination temperature (step 168), the defrost operation is terminated, pursuant to step 169. If the coil temperature of evaporator 12 is not above the termination temperature (step 168), controller 20 recalls a stored defrost termination time duration (step 170), which corresponds to the maximum allowed time of the defrost operation. Controller 20 then determines, pursuant to step 171, if the termination time duration, which is user-programmable, has been set for less than 45 minutes. If it has, controller 20 uses 45 minutes as the termination time duration, pursuant to step 172. If the termination time programmed by the user is not less than 45 minutes, the program termination time is used and controller 20 determines, pursuant to step 173, whether the duration of the defrost operation has exceeded the termination time. If it has not, controller 20 branches back and continues to check for a condition indicating termination of the defrost operation. If the defrost operation has exceeded the allowed time (step 173), the defrost operation is ended, pursuant to step 169.

One skilled in the art will recognize that the defrost operation is terminated if the coil temperature of evaporator 12 exceeds a predetermined temperature (i.e., the termination temperature, pursuant to step 168), or if the duration of the defrost operation exceeds a predetermined duration (i.e., the termination time duration, pursuant to step 173), whichever occurs first. After the defrost operation has been terminated, pursuant to step 169, the defrost time duration is stored, pursuant to step 174, and Subroutine 160 is exited.

In accordance with the present invention, an improved defrost controller is provided for a space cooling system. The defrost operation is initiated only in response to a demand therefor and only at a predetermined allowed time. A demand for defrost is indicated by a change in a selected one or more system operating parameters indicating degradation in evaporator performance due to frost build-up thereon. In accordance with a preferred embodiment of the invention, a demand for defrost is determined by monitoring the position of the expansion valve at the evaporator inlet. As frost builds up on the evaporator, the expansion valve gradually closes to maintain a desired level of superheat across the evaporator. When the expansion valve is closed to a position below a predetermined defrost target position, a demand for defrost is indicated. The present invention also makes allowance for changes in system operating parameters, such as space temperature and compressor discharge temperature, which may affect the position of the expansion valve in a way which is not related to frost build-up on the evaporator. The system controller takes these changes into account and adjusts the defrost target valve position accordingly.

Various embodiments of the invention have now been described in detail. Since it is obvious that changes in and additions to the above-described best mode may be made without departing from the nature, spirit or scope of the invention, the invention is not to be limited to said details, but only by the appended claims and their equivalents.

What is claimed is:

1. In a space cooling system having a first heat exchanger in heat exchange relationship with a space to be cooled, a second heat exchanger external to the space, a circulating device for circulating heat transfer fluid between the first heat exchanger and the second heat exchanger, a regulating device located between the first heat exchanger and the second heat exchanger for regulating heat transfer fluid flow rate through the first heat exchanger and a defroster operatively associated with the first heat exchanger, control apparatus operable to control the defroster to defrost the first heat exchanger in response to both of the following conditions having been satisfied;

(i) a demand for defrost is indicated by a change in a selected one or more system operating parameters indicating degradation in performance of the first heat exchanger due to frost build-up thereon; and (ii) said demand for defrost occurs at a time of day corresponding to a predetermined allowed defrost time;

said control apparatus being operable to control the defroster to terminate defrosting of the first heat exchanger in response to a predetermined defrost condition having been satisfied.

2. The control apparatus of claim 1 further including means responsive to an absence of said demand for defrost for determining at each allowed defrost time whether defrosting of the first heat exchanger [the defrost operation] can be deferred until a next allowed defrost time.

3. The center apparatus of claim 2 wherein said determining means includes:

computing means for computing first and second ratios, said first ratio having a numerator which represents present degradation in performance of the first heat exchanger compared to a predetermined reference performance and a denominator which represents a predetermined allowed degradation in said performance compared to said reference performance, said second ratio having a numerator which represents time elapsed since a last defrost operation and a denominator which represents a time interval from the last defrost operation to a next allowed defrost time; and comparing means for comparing said first and second ratios, said control apparatus being further operable to activate the defroster at an allowed defrost time in response to said first ratio being at least as large as said second ratio.

4. The control apparatus of claim 1 further including means responsive to an absence of said demand for defrost for determining at each allowed defrost time whether defrosting of the first heat exchanger can be deferred until a next allowed defrost time, based upon a computed rate of degradation in performance of the first heat exchanger.

5. The control apparatus of claim 1 wherein said predetermined allowed defrost time corresponds to a predetermined time period during which defrosting of the first heat exchanger is allowed to begin.

6. A space cooling system, comprising:

a first heat exchanger in heat exchange relationship with a space to be cooled;

a second heat exchanger external to the space;

a circulating device for circulating heat transfer fluid between said first heat exchanger and said second heat exchanger;

a regulating device located between said first heat exchanger and said second heat exchanger for regulating heat transfer fluid flow rate through said first heat exchanger;

a defroster operatively associated with said first heat exchanger; and a defrost controller operable to control said defroster to defrost said first heat exchanger in response to both of the following conditions having been satisfied:

(i) a demand for defrost is indicated by a change in one or more system operating parameters indicating degradation in performance of said first heat exchanger due to frost build-up thereon; and (ii) said demand for defrost occurs at a time of day corresponding to a predetermined allowed defrost time;

said defrost controller being further operable to control the defroster to terminate defrosting of said first heat exchanger in response to a predetermined defrost condition having been satisfied.

7. The system of claim 6 wherein said controller includes means responsive to an absence of said demand for defrost for determining at each allowed defrost time whether defrosting of the first heat exchanger can be deferred until a next allowed defrost time.

8. The system of claim 7 wherein said determining means includes:

computing means for computing first and second ratios, said first ratio having a numerator which represents present degradation in performance of said first heat exchanger compared to a predetermined reference performance and a denominator which represents a predetermined allowed degradation in said performance compared to said reference performance, said second ratio having a numerator which represents time elapsed since a last defrost operation and a denominator which represents a time interval from the last defrost operation to a next allowed defrost time; and comparing means for comparing said first and second ratios, said controller being further operable to activate the defroster at an allowed defrost time in response to said first ratio being at least as large as said second ratio.

9. The system of claim 6 wherein said controller includes means responsive to an absence of said demand for defrost for determining at each allowed defrost time whether defrosting of said first heat exchanger can be deferred until a next allowed defrost time, based on a computed rate of degradation in performance of said first heat exchanger.

10. The system of claim 6 wherein said predetermined allowed defrost time corresponds to a predetermined time period during which defrosting of said first heat exchanger is allowed to begin.

* * * * *